US007883391B1

(12) United States Patent
Asomani

(10) Patent No.: US 7,883,391 B1
(45) Date of Patent: Feb. 8, 2011

(54) WARMER AND HOLDER FOR BABY BOTTLE

(76) Inventor: Kwabena Asomani, 9716 Indian Princess Dr., Fort Washington, MD (US) 20744

( * ) Notice: Subject to any disclaimer, the term of this patent is extended or adjusted under 35 U.S.C. 154(b) by 204 days.

(21) Appl. No.: 11/889,626

(22) Filed: Aug. 15, 2007

(51) Int. Cl.
*A63H 33/00* (2006.01)
*A63H 3/00* (2006.01)

(52) U.S. Cl. ..... 446/28; 446/74; 446/227; 446/304; 446/369

(58) Field of Classification Search ..... 446/26, 446/28, 71–76, 81, 227, 297, 304, 369, 484
See application file for complete search history.

(56) References Cited

U.S. PATENT DOCUMENTS

| | | | | | |
|---|---|---|---|---|---|
| 2,647,195 | A * | 7/1953 | Broyles | 219/473 |
| 4,188,747 | A * | 2/1980 | Kramer | 446/73 |
| 4,277,910 | A * | 7/1981 | Kramer | 446/73 |
| 4,280,292 | A * | 7/1981 | Hills | 40/538 |
| 4,714,445 | A * | 12/1987 | Templeton | 446/74 |
| 4,833,443 | A * | 5/1989 | Siew | 340/473 |
| 4,979,923 | A * | 12/1990 | Tanaka | 446/72 |
| 5,217,192 | A * | 6/1993 | Oktayuren | 248/102 |
| 5,326,300 | A * | 7/1994 | Sonders | 446/74 |
| 5,436,429 | A * | 7/1995 | Cline | 219/202 |
| 5,749,764 | A * | 5/1998 | Bailey | 446/427 |
| 5,979,843 | A * | 11/1999 | Beck | 248/102 |
| 6,003,821 | A * | 12/1999 | Fabian et al. | 248/104 |
| 6,019,659 | A * | 2/2000 | Walters | 446/72 |
| 6,523,792 | B2 * | 2/2003 | Fishler | 248/102 |
| 6,592,084 | B1 * | 7/2003 | Nile | 248/104 |
| 6,641,094 | B2 * | 11/2003 | Fishler | 248/102 |
| 6,692,330 | B1 * | 2/2004 | Kulick | 446/297 |
| 6,739,933 | B2 * | 5/2004 | Taylor | 446/28 |
| 6,827,317 | B1 * | 12/2004 | Maki Risaliti | 248/102 |
| 6,915,991 | B1 * | 7/2005 | Shomer et al. | 248/106 |
| 7,080,810 | B2 * | 7/2006 | Munjed | 248/102 |
| 2007/0210219 | A1 * | 9/2007 | Hiller | 248/102 |

* cited by examiner

*Primary Examiner*—Gene Kim
*Assistant Examiner*—Scott Young
(74) *Attorney, Agent, or Firm*—Harbin & Hein PLLC

(57) ABSTRACT

A stuffed animal or doll that holds, stows, or warms a feeding bottle of an infant. The stuffed animal or doll includes adjustable straps extending forwardly from arms and legs thereof to adjustably embrace the infant in a face-to-face posture; flexible appendages in the form of rabbit ears having a Velcro fastener to circumscribe, clamp, and hold the feeding bottle in a feeding position relative to the infant when embraced by the adjustable straps; a battery-powered warmer pouch disposed at a posterior region of the animal doll to provide stowage and/or warming of a feeding bottle when not in use by the infant, and a voice-activated record/playback to record and repeatedly playback an audio track recorded by a caretaker of said infant. In addition, a speaker may be embedded inside the stuffed animal to playback a music track for the infant.

8 Claims, 3 Drawing Sheets

30
32
10
12
18
56
54
50
14
16
22
52
24
28

WARMER AND HOLDER FOR BABY BOTTLE

BACKGROUND

This invention relates to a parental convenience item, but more specifically a holder and warmer for a baby feeding bottle to afford hands-free attendance of an infant. Since human infants prefer to feed on warm milk, many parents typically utilize a bottle warmer to achieve and maintain a desired temperature prior to feeding. The parent usually feeds the infant by holding the bottom of the bottle upright in a position to enable to infant to draw milk (or other liquids) from a nipple at the top of the bottle. This requires two hands, i.e., one to hold the child and the other to hold the bottle. Because the parent often has other chores requiring use of a hand, feeding often becomes inconvenient.

To alleviate the inconvenience, infant bottle holders have previously been used. Examples are shown by U.S. Pat. Nos. 6,003,821; 5,092,549; 5,953,816; 6,082,681; 5,979,843; and 5,326,300. It is also evident that a stuffed animal, toy, or doll may be configured to serve as a bottle holder. U.S. Pat. No. 5,217,192, for example, additionally discloses a music player associated with a stuffed doll bottle holder, as well as a looped ear of a rabbit to hold an infant bottle in a feeding position. Apart from warming the milk in a microwave oven or on a stovetop, bottle warmers have also been used in the prior art.

The combination of a bottle holder and a bottle warmer, however, has not previously been provided.

In accordance with an aspect of the present invention, such combination affords greater convenience to the parent, greater parental mobility, and may free the parent to attend other chores while attending the infant.

SUMMARY OF THE INVENTION

In accordance with a first aspect of the invention, there is provided a stuffed animal (e.g., a doll, animal, toy, or other item) that holds, stows, and/or warms a feeding bottle of an infant. The stuffed animal includes adjustable straps extending from an anterior region thereof to encircle and adjustably embrace the infant in a face-to-face posture; flexible appendages extending from an upper region of the stuffed animal to circumscribe, clamp, and hold the feeding bottle in a feeding position relative to the infant when embraced by the adjustable straps of the stuffed animal; and a warmer pouch attached to the stuffed animal to provide stowage and/or warming of a feeding bottle. In an illustrated embodiment, the stuffed animal comprises a bunny rabbit and the flexible appendages include elongated ears of the bunny rabbit. The warmer pouch may be disposed on the rear portion of the bunny, and may be battery-operated or obtain power from a cigarette lighter adapter and umbilical cord.

In a further embodiment, said stuffed animal includes a voice or manually activated audio device to record and repeatedly playback a parental voice in order to sooth the infant with a familiar voice. A pacifier may also extend from the upper portion or mouth of the bunny rabbit and a music player may be incorporated into the bulk of the stuffed animal to play soothing music or a familiar voice of a parent or caretaker.

In accordance with another aspect of the invention, there is provided a stuffed animal to hold, stow, and/or warm a feeding bottle of an infant wherein the stuffed animal comprises adjustable straps extending forwardly from arms of the stuffed animal to adjustably embrace the infant in a face-to-face posture with said stuffed animal; flexible appendages disposed on said stuffed animal having a Velcro fastener to circumscribe, clamp, and hold a feeding bottle in a feeding position relative to the infant when embraced by the adjustable straps of said stuffed animal; and a battery-operated warmer pouch disposed about a posterior region of the stuffed animal to provide stowage and/or warming of a feeding bottle when not in use by the infant.

In yet an additional embodiment of the invention, there is provided a stuffed animal doll that holds, stows, or warms a feeding bottle of an infant wherein the doll includes adjustable straps extending forwardly from arms and legs of the stuffed animal to adjustably embrace the infant in a face-to-face posture; flexible appendages disposed on a head of the animal doll having a Velcro fastener to circumscribe, clamp, and hold the feeding bottle in a feeding position relative to the infant when embraced by the adjustable straps; a battery-operated warmer pouch disposed about a posterior region of the animal doll to provide stowage and/or warming of a feeding bottle when not in use by the infant, and a record/playback device to record and repeatedly playback an audio track recorded by a caretaker of said infant. This embodiment may also include a voice-activated or manually-controlled record/playback device to record an audio track for subsequent playback. Playback may be repeatedly or periodically activated. In addition, this embodiment may include a music playback device and a speaker embedded inside the stuffed animal to playback a music track for the infant.

Other aspects, features, and embodiments of the invention will become apparent upon review of the following description of illustrative embodiments taken in connection with the accompanying drawings. The invention though is pointed out with particularity by the appended claims.

DESCRIPTION OF ILLUSTRATIVE EMBODIMENTS

Figure 1:
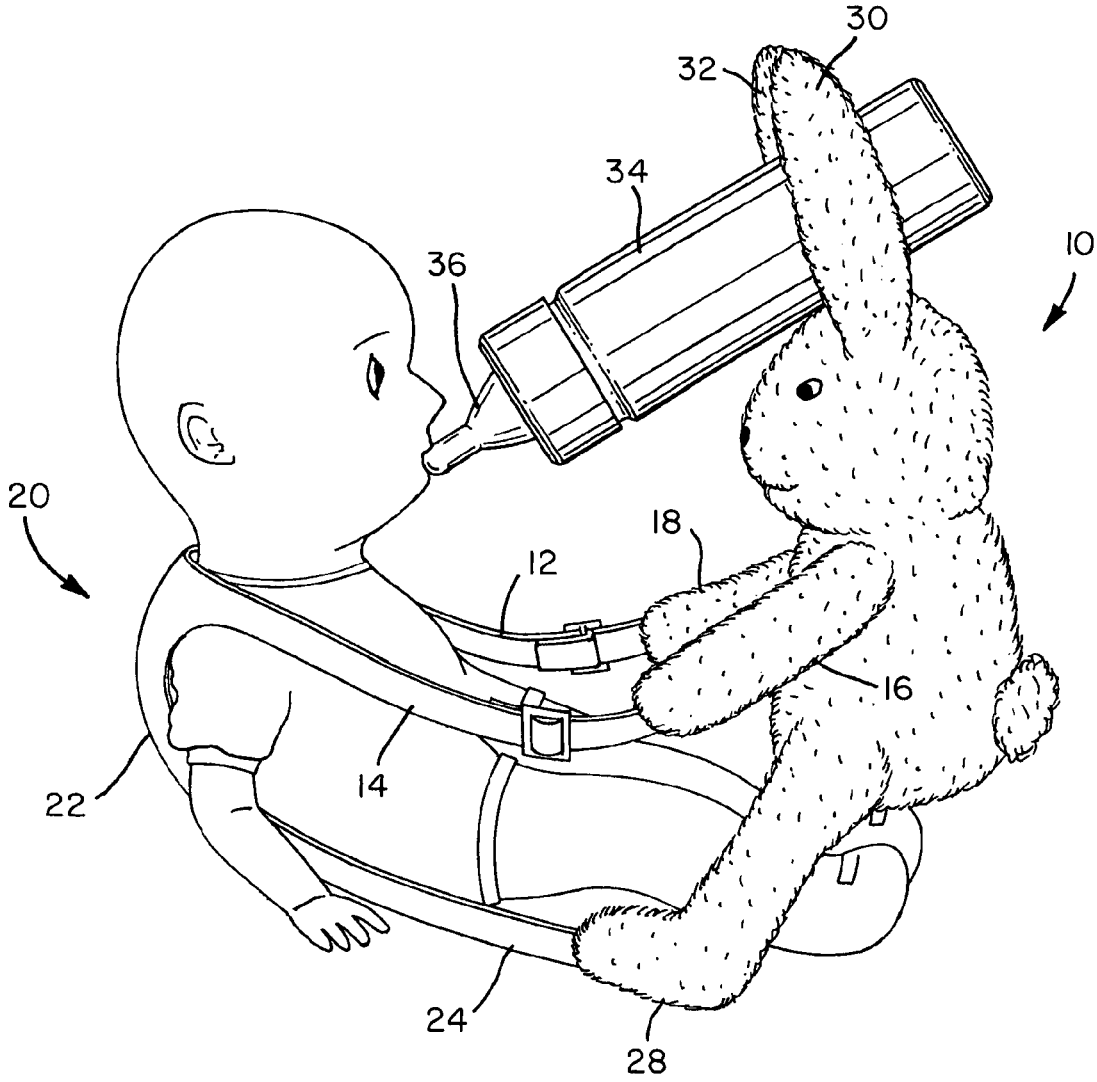
FIG. 1 shows a first aspect of the invention comprising a stuffed animal having flexible appendages to hold a feeding bottle and adjustable straps to embrace and cradle an infant.

In FIG. 1, an embodiment of the invention is illustrated in the form of a stuffed bunny rabbit 10 having a pair of adjustable straps 12, 14 extending from arms 16, 18 of rabbit 10 and extending over shoulders of an infant 20. The stuffed animal itself is rather conventional in being a soft, comfortable, and sometime furry creature suitable for cuddling by an infant. The straps may be integrated with the stuffed animal to form a cradle 22 embracing the back of the infant 20, which includes strap extensions 24 (only one shown) that couple the legs or feet 28 (only one shown) of rabbit 10 so that an anterior side of the rabbit 10 straddles the infant. The adjustable straps 14 extend from an anterior side of the rabbit, for example, from the arms 16, 18 of the stuffed animal to adjustably embrace the infant 20 in a face-to-face posture. Adjustment may be accomplished by conventional Velcro fastening elements on the straps, or by friction coupling clamps through which the straps are inserted. In essence, the adjustable straps extend from arms (i.e., front legs of the rabbit) and rear legs of the stuffed animal to embrace and/or cradle the infant over shoulders.

To hold a feeding bottle 34 so as to place the nipple 36 in an accessible feeding position, the rabbit 10 includes a pair of flexible appendages in the forms of elongated ears 30, 32 having Velcro (or other) fasteners on the tips thereof in order to circumscribe, clamp, and hold the feeding bottle in an appropriate feeding position relative to the infant when embraced by the adjustable straps of the bunny rabbit. Suitable flexibility and clamping may be achieved by fabric material having Velcro or by a fabric material having embedded therein a soft malleable wire stiffening element.

Although a bunny rabbit is illustrated, it is understood that such a stuffed animal may comprise any type of animal, toy, or stuffed creature—the objective being to accommodate the comfort of a child or infant.

Figure 2:
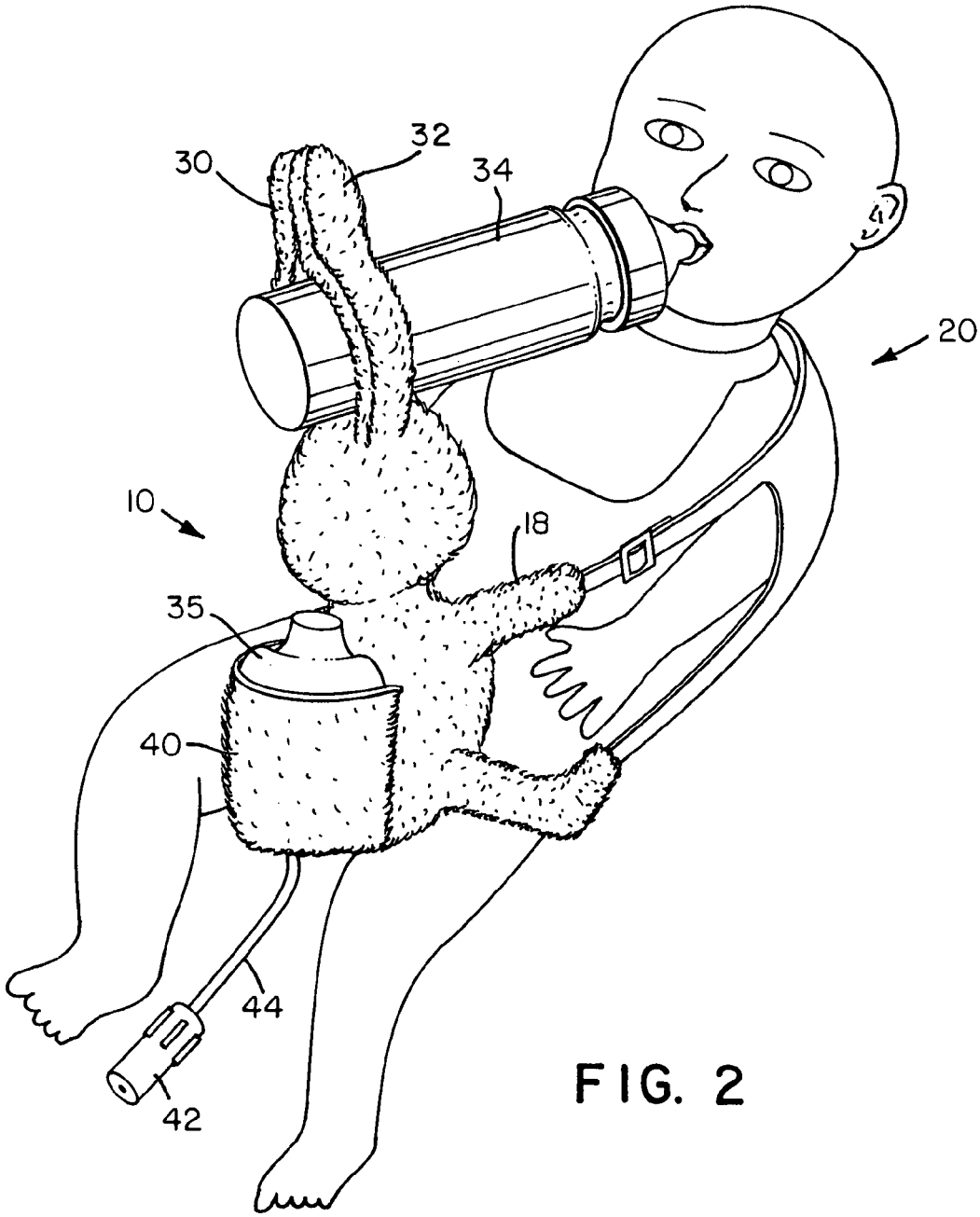
FIG. 2 shows a second aspect of the invention further including a warmer pouch disposed on the animal doll to stow and/or heat a feeding bottle.

In FIG. 2, wherein like reference numerals indicate like elements, there is shown a stowing and warming pouch 40 disposed on a posterior or rear side of the rabbit 10 to stow and/or warm the primary feeding or a secondary feeding bottle 35. The warmer pouch includes a battery-operated heater element to warm the bottle. The heating element may include a cigarette lighter adaptor 42 and power cord 44 to energize the heating element while traveling in a motor vehicle. Pouch 40 may also include a conventional thermostat to regulate the temperature of feeding bottle 35 (e.g., at or near body temperature, typically 98-100° F.) and to prevent overheating. Safety measures may also be implemented, such as providing a break-away or tangle-free power cord 44 to prevent entanglement/chocking, and/or providing a fuse to prevent burns, overheating, or electrical shock.

Figure 3:
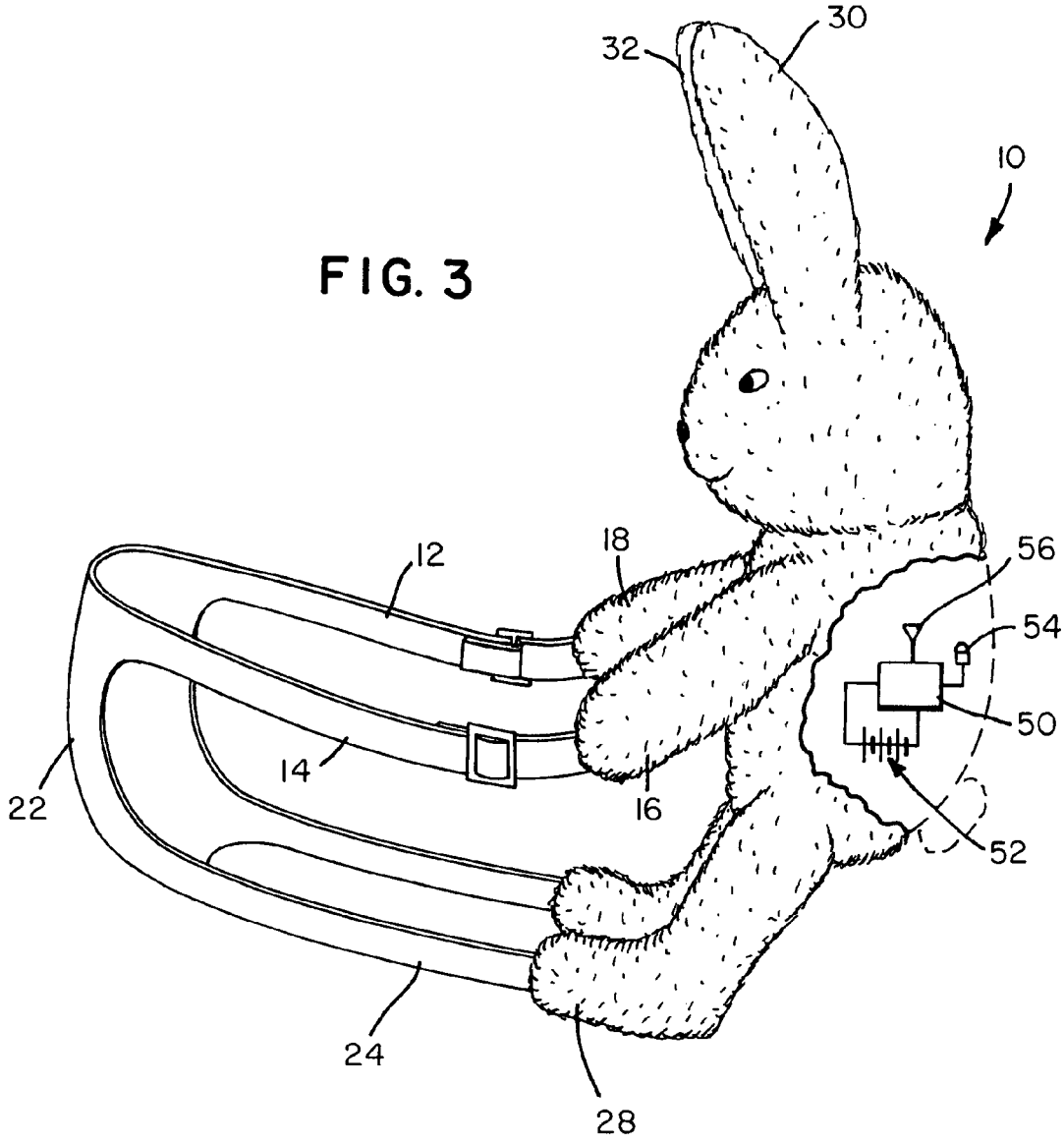
FIG. 3 shows another aspect of the invention wherein the stuffed animal includes a battery-operated audio device to record and playback a parental voice to calm an infant.

In yet a further embodiment of the invention, as shown in FIG. 3, the stuffed animal includes a conventional battery-operated audio device 50 embedded within the corpus of stuffed animal to record and playback a parental voice to calm or sooth the infant with a familiar voice. The audio device is powered by a battery 52, and includes a microphone 54 and a speaker 56. In a typical operation, a parent may speak, hum, or sing into microphone 54, which device records and periodically or repeatedly plays back through speaker 54 a soothing voice that is are familiar to the infant. This may help quiet an otherwise distracted or agitated infant. The record function of the audio device may be voice-activated or manually controlled.

In addition or alternatively, the stuffed animal may include a battery-operated music player to play music for the infant. The player also includes a speaker embedded in the stuffed animal to playback a music track.

In a further embodiment, the stuffed animal may include a pacifier extending from an upper region of the stuffed item or mouth of the bunny rabbit.

Variation and adaptations may come to those skilled in the art based on the above teachings. As such, the invention covers such extensions and extrapolations as may fall within the scope of the appended claims.

I claim:

1. A stuffed animal that holds, stows, and/or warms a feeding bottle of an infant, said stuffed animal comprising:

a cradle having adjustable straps extending from an anterior region of the stuffed animal to embrace the infant in a face-to-face posture;

flexible appendages extending from an upper region of the stuffed animal to circumscribe, clamp, and hold a feeding bottle in a feeding position relative to the infant when embraced by said cradle; and a flexible warmer pouch having a battery-powered heating element disposed on a rear of said stuffed animal to provide readily accessible retrieval, stowage and warming of a feeding bottle when not in use by said infant, said heating element further including a thermostat to control temperature of said bottle, an automobile cigarette lighter adapter and cord to receive power, and a fuse to limit current supplied thereto.

2. The invention of claim 1 wherein said stuffed animal comprises a stuffed bunny rabbit and the flexible appendages comprises elongated ears of said stuffed bunny rabbit.

3. The invention of claim 2, wherein said stuffed bunny rabbit further includes a pacifier extending from mouth of the bunny rabbit.

4. The invention of claim 1 wherein said adjustable straps extend from arms and legs of the stuffed animal to embrace the infant over shoulders of the infant.

5. The invention of claim 3 wherein said stuffed animal further includes an audio device to record and playback a parental voice of said infant in order to sooth the infant with a familiar voice.

6. A stuffed animal to hold, stow, and/or warm a feeding bottle of an infant, said stuffed animal comprising:

a cradle having adjustable straps extending forwardly from arms and legs of the stuffed animal to embrace the infant in a face-to-face posture with said stuffed animal;

flexible appendages disposed on said stuffed animal having a Velcro-type fastener to circumscribe, clamp, and hold a feeding bottle in a feeding position relative to the infant when embraced by the adjustable straps of said stuffed animal; and a warmer pouch having a battery-powered heating element disposed on a rear of said stuffed animal to provide readily accessible retrieval, stowage and/or warming of a feeding bottle when not in use by the infant, said heating element further including a thermostat to control temperature of said bottle, an automobile cigarette lighter adapter and cord to receive power, and a fuse to limit current supplied thereto.

7. An animal doll that holds, stows, or warms a feeding bottle of an infant, said animal doll comprising:

a cradle having adjustable straps extending forwardly from arms and legs of the animal doll to adjustably embrace the infant in a face-to-face posture;

flexible appendages disposed on a head of the animal doll having a Velcro-type fastener to circumscribe, clamp, and hold the feeding bottle in a feeding position relative to the infant when embraced by the adjustable straps;

a battery-operated warmer pouch disposed on a rear of the animal doll to provide readily accessible retrieval, stowage and/or warming of a feeding bottle when not in use by the infant, said warmer pouch further including a thermostat to control temperature of said bottle, an automobile cigarette lighter adapter and cord to receive power, and a fuse to limit current supplied thereto, and a record/playback (voice-activated) to record and repeatedly playback an audio track recorded by a caretaker of said infant.

8. The animal doll of claim 7, wherein said record/playback device is voice activated to record an audio track for subsequent playback.

* * * * *